United States Patent [19]

Whiting

[11] 4,142,264

[45] Mar. 6, 1979

[54] CONVERTIBLE COMFORT OR GARMENT

[75] Inventor: Richard T. Whiting, Cincinnati, Ohio

[73] Assignee: Whiting Manufacturing Company, Inc., Cincinnati, Ohio

[21] Appl. No.: 892,214

[22] Filed: Mar. 31, 1978

[51] Int. Cl.[2] ..... A47G 9/00; A47G 9/06

[52] U.S. Cl. ..... 5/334 R; 2/69.5

[58] Field of Search ..... 2/69, 69.5, 88, 94; 5/334 R, 334 C, 335; D2/2, 25

[56] References Cited

U.S. PATENT DOCUMENTS

| | | | |
|---|---|---|---|
| D. 249,196 | 9/1978 | Wrightson | D2/25 |
| 536,383 | 3/1895 | Huyck | 2/69.5 |
| 906,551 | 12/1908 | Newman | 2/69.5 |
| 1,265,539 | 5/1918 | Slater | 2/69.5 |
| 1,454,541 | 5/1923 | Falvey | 2/69.5 |
| 1,509,296 | 9/1924 | Hopewell | 2/88 |
| 2,442,105 | 5/1948 | Vacheron | 2/69.5 |
| 2,656,540 | 10/1953 | Stephenson | 2/69.5 |
| 2,967,306 | 1/1961 | Fabanich | 2/94 |
| 3,858,256 | 1/1975 | Beer | 5/334 C |

*Primary Examiner*—Mervin Stein
*Assistant Examiner*—Andrew M. Calvert
*Attorney, Agent, or Firm*—Melville, Strasser, Foster & Hoffman

[57] ABSTRACT

There is disclosed a comforter of conventional shape and size, provided along its edges with a particular arrangement of male and female fastening elements, whereby said comforter may be used in a conventional manner on a bed, and yet by folding and securing said fastening elements as taught hereinafter, the comforter may be converted into a bag-like structure to be worn as a garment, covering the body of the user while leaving the head and hands exposed.

1 Claim, 3 Drawing Figures

CONVERTIBLE COMFORT OR GARMENT

BRIEF SUMMARY OF THE INVENTION

Comforters as used on beds are well known. They are usually rectangular, and may have an upper decorative or print side, and a plain underside, with a filling material therebetween and the comforters are generally quilted. The underside may be of the same material as the upper side, or it may be a different material and the underside may or may not be decorative.

It is an object of the present invention to provide along opposed longitudinal side edges of such a comforter over a greater portion of the length of said longitudinal edges from one end, a series of cooperating fastening elements, so that the longitudinal side edges may be folded in toward the center and secured together along a medial line. A series of cooperating fastening elements are also provided along the adjacent transverse side edge (bottom edge) and these may be secured together to form a bag-like structure open at its upper portion.

Additional cooperating fastening elements are provided along the opposite transverse side edge (top edge) so that the corners of the top edge may be folded downward and secured together by means of said last mentioned fastening elements, leaving a neck opening, and also a transverse opening through which the hands may be thrust for eating, holding a book, or the like.

The article of the present invention makes it possible for a person to be warm while eating, reading, or watching television, even if the room temperature is turned down to 50° or 60° F. to conserve energy. If it should become necessary to open the door or to move about for any reason, the user may undo the fastening elements along the bottom of the article and thrust his feet out while holding the comforter up off the floor, whereupon he can walk around without difficulty.

Upon retiring, the fastening elements may all be undone and the article spread on the bed to serve as a conventional comforter.

DETAILED DESCRIPTION

While a normal comforter is simply rectangular in shape and may be the same on both sides, some comforters have a so-called print side which may carry a design or a pattern while the other side may be of plain material and such a comforter is designed to be used on a bed with the print side up.

Hereinafter the term "print side" will be used to designate the top of the comforter as it lies on a bed while the underside will be designated as the side which is not exposed to view when the comforter is disposed on a bed.

The fastening elements referred to hereinafter will be specifically described as snap fasteners, although the so-called Velcro fasteners may be used as well.

Figure 1:
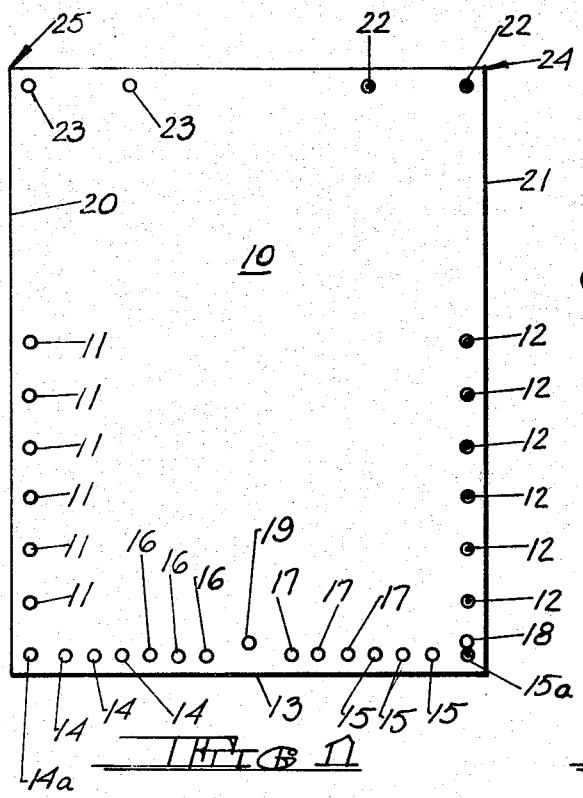
FIG. 1 is a plan view of an article according to the invention opened up for use as a comforter, and illustrating the location of the fastening elements.

Referring first to FIG. 1, there is shown a plan view of a comforter indicated at 10, which is conventionally of rectangular shape and generally of so-called twin bed size which may be 84 inches long by 66 inches wide. These figures should be understood to be exemplary only and not to constitute a limitation upon the invention.

The various small circles indicate the location of various fastening elements. It will be understood that the side viewed in FIG. 1 will be considered the top side or print side of the comforter. If the comforter is of the same material and pattern on both sides, then either side may constitute the top.

Along one side of the comforter there is disposed a row of female fastening elements 11 and if these are snap fasteners, it will be understood that the snap side will be on the underside.

Along the opposite longitudinal edge 12 there is disposed a row of male fastening elements with the snap side upward.

Along one side of the bottom edge 13 of the comforter there is provided a row of female fastening elements 14 with the snap side on the underside and if Velcro fasteners are used, the female Velcro fastener at 14 will be on the underside of the comforter. At 16 there is shown a row of male fastening elements 16. These are disposed with the snap side down.

On the other side of center of the edge 13 there is provided a row of female fastening elements with the fastening or snap side down, and a row of male fastening elements 17 also arranged with their snap side down.

At 18 there is provided a female fastening element with the snap side down and at 19 there is provided a male fastening element with the snap side down. It will be noted that the outermost of the row of fastening elements 14 is designated as **14*a* and the outermost of the row of fastening elements 15 is designated as 15*a***.

Assuming that the comforter 10 is laid on the floor with the side showing in the drawing down, the longitudinal edges 20 and 21 are folded in toward the middle and the respective mating fasteners 11 and 12 are secured together and at the bottom edge 13 the fastening elements 15 are secured to the elements 17 and the fastening elements 14 are secured to the fastening elements 16. The fastening element 18 is secured to the fastening element 19. The fastening element **14*a* is secured to 15*a***.

When the fastening elements thus far described are secured together, there is formed a bag-like structure which is open at the top.

It will be observed that along the top edge there are provided the female fastening elements 23 and the male fastening elements 22. The elements 23 have their snap side down, while the elements 22 have their snap side up.

When the upper corners 25 and 24 are folded down, the respective fastening elements 22 and 23 may be secured together and the upper end of the bag then exhibits a neck hole 26.

The top edge of the comforter now includes the margins of the neck hole and the joint down the front, and the portions 20 and 21 of the longitudinal edges which do not have fastening elements comprise an open portion through which the user's hands may extend for the purpose of reading or eating.

Figure 3:
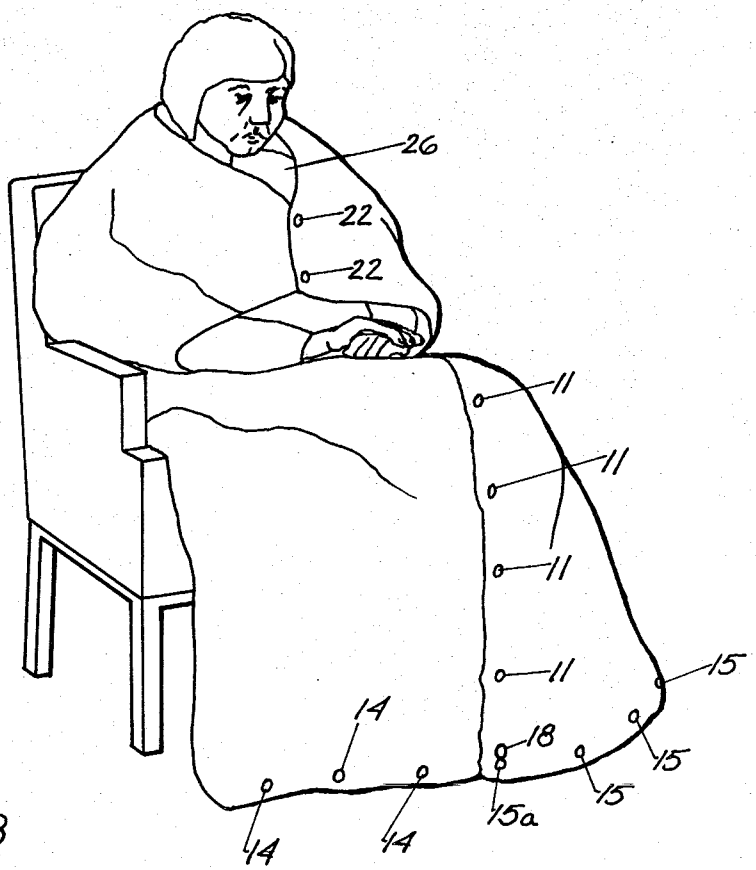
FIG. 3 is a perspective view showing the use of the article as a garment.

FIG. 3 demonstrates the appearance of the garment with a user sitting in it and demonstrates how the head and the hands are exposed while the rest of the body is protected.

If it should become necessary for the user to answer the doorbell or move about for any reason whatever, it is only necessary to unsnap the snaps 14 and 15, whereupon the user may thrust his feet out and by lifting up the garment may walk about without difficulty.

When the user is ready to retire he simply unfastens all the fastening elements so that the garment assumes the condition of FIG. 1 and he can then spread it upon the bed and use it as a conventional comforter.

Figure 2:
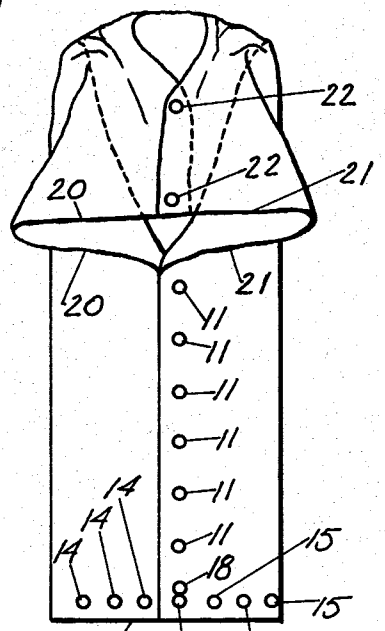
FIG. 2 is a plan view showing the article fastened together by means of the fastening elements to form a garment.

The rolls of fastening elements 11 and 12 should preferably extend between about 52% and about 67% of the length of the sides 20 and 21 from the bottom and the distance between the innermost fastening element 23 and the innermost of the fastening elements 22 should be between about 42% and about 72% of the width of the top edge of the comforter so as to leave sufficient room for the neck and head when the device is in the condition of FIG. 2.

Generally speaking, the comforter is of the so-called twin bed size which is about 84 × 66 inches but this is not a limitation on the invention.

It will be understood that if Velcro fastening elements are used instead of snap fasteners, wherever reference has been made to the snap side being up or down, it will be the Velcro element on the upper or under side of the comforter.

It will be understood that numerous modifications may be made without departing from the spirit of the invention and no limitation is therefore intended other than limitations specifically set forth in the claims and no such limitation should be implied.

The embodiments of the invention in which an exclusive property or privilege is claimed are defined as follows:

1. A comforter of conventional rectangular shape having on its under side along one of its longer edges, a row of female fastener elements and having on its upper side, along the opposite longer edge, a like row of male fastening elements, said rows of fastening elements extending between about 52% and about 67% of the length of the comforter from its bottom edge, said comforter having along approximately the outer half portions of its bottom edge on its under side, a number of female fastening elements, and having along approximately the inner half portions of its bottom edge on its upper side a like member of male fastening elements, whereby the comforter may be disposed with its under side up and the longer edges folded in toward the center and secured together by means of said two first mentioned rows of fastening elements, and the lapped bottom edges may be secured together by means of said two last mentioned sets of fastening elements to form a bag-like structure with the print side out, said comforter further including at least two female fastening elements disposed on the under side along one side of the top edge of the comforter and a like member of male fastening elements disposed on the upper side at the other side of the top edge of the comforter, the innermost ones of said last mentioned male and female fastening elements being spaced apart from about 42% to about 72% of the width of the comforter, whereby the last named sets of fastening elements may be secured together with the upper corners of said comforter folded downwardly to cover the shoulders while leaving the head and hands of a user exposed.

* * * * *

UNITED STATES PATENT AND TRADEMARK OFFICE

CERTIFICATE OF CORRECTION

PATENT NO. : 4,142,264

DATED : March 6, 1979

INVENTOR(S) : Richard T. Whiting

It is certified that error appears in the above-identified patent and that said Letters Patent are hereby corrected as shown below:

Column 3, line 12, the word "rolls" should be -- rows --.

Column 4, line 15, the word "upper" should be -- under --; and the word "member" should be -- number --.

Signed and Sealed this

*Eleventh* Day of *December 1979*

[SEAL]

*Attest:*

SIDNEY A. DIAMOND

*Attesting Officer*

*Commissioner of Patents and Trademarks*